United States Patent [19]

Higgins

[11] Patent Number: 4,488,712

[45] Date of Patent: Dec. 18, 1984

[54] LONGITUDINALLY LACED CONTINUOUS COIL SPRING ASSEMBLY

[75] Inventor: Larry Higgins, Carthage, Mo.

[73] Assignee: Leggett & Platt, Incorporated, Carthage, Mo.

[21] Appl. No.: 332,490

[22] Filed: Dec. 21, 1981

[51] Int. Cl.[3] ..... F16F 3/04; A47C 23/04

[52] U.S. Cl. ..... 267/91; 5/248; 5/269; 267/93; 267/95

[58] Field of Search ..... 267/91, 93, 95, 97, 267/101, 103, 105, 106; 5/248, 256, 267, 268, 269, 270, 271, 272, 273, 274, 275, 276, 277, 247, 255, 474, 475, 476

[56] References Cited

U.S. PATENT DOCUMENTS

| | | | |
|---|---|---|---|
| 630,967 | 8/1899 | Bonnell | 5/269 |
| 1,943,067 | 1/1934 | Foster | 5/248 |
| 3,657,749 | 4/1972 | Norman . | |
| 3,685,062 | 8/1972 | Pearson et al. | 267/91 X |
| 3,911,511 | 10/1975 | Higgins et al. . | |
| 3,916,464 | 11/1975 | Tyhanic | 5/248 X |
| 4,358,097 | 11/1982 | Zopletal et al. | 267/101 |

FOREIGN PATENT DOCUMENTS

| | | | |
|---|---|---|---|
| 173746 | 7/1906 | Fed. Rep. of Germany | 5/248 |
| 201115 | 8/1908 | Fed. Rep. of Germany | 5/475 |
| 2705956 | 12/1977 | Fed. Rep. of Germany | 267/91 |
| 365279 | 6/1906 | France | 5/475 |
| 1224380 | 2/1960 | France | 5/269 |

*Primary Examiner*—George E. A. Halvosa

*Attorney, Agent, or Firm*—Wood, Herron & Evans

[57] ABSTRACT

A spring assembly for mattresses, innersprings, and the like. The assembly comprises longitudinal rows of coils, each row comprising a continuous length of wire formed into a plurality of coils interconnected by Z-shaped wire segments alternately disposed at the top and bottom of the coils. Adjacent rows of coils are connected by longitudinally extending helical lacing wires wound through overlapping Z-shaped wire segments. By lacing the rows of coils longitudinally, the spacing between adjacent coils may be varied in selected longitudinal sections of the unit so as to vary the coil count and thus the firmness of selected areas of the assembly, as for example the center section. Furthermore, by so lacing the rows of coils, a single set-up of forming and assembly machine may be used to manufacture various widths of mattresses, as for example, twin, double or queen and king size units.

3 Claims, 7 Drawing Figures

LONGITUDINALLY LACED CONTINUOUS COIL SPRING ASSEMBLY

The present invention relates to spring assemblies of the type commonly used in the construction of innersprings, mattresses, upholstered furniture, and the like. More particularly, the present invention relates to a mattress spring core assembly in which each of the rows of coils is formed from a single continuous length of wire.

The prior art is replete with spring assemblies useful for mattresses, innersprings, and the like. While these are of various configurations, most of them employ rows of individual coils interconnected at the top and bottom by wire lacings.

Recently, a spring assembly has been developed which is in many ways superior to an assembly which employs rows of interconnected individual coils. This new spring assembly utilizes a single continuous wire to form all of the coil springs of a row of coils. Such a construction is illustrated and described in U.S. Pat. Nos. 3,657,749 and 3,911,511 and pending application Ser. No. 212,818, filed Oct. 4, 1980, now U.S. Pat. No. 4,358,097 and assigned to the assignee of this application.

The continuous coil spring products disclosed in U.S. Pat. No. 3,911,511 and the above identified pending patent application have been commercial successes, primarily because considerably less material is required for the same degree of firmness in an upholstered spring product than has been employed in spring assemblies which utilize rows of interconnected individual coil springs. But, the spring products made from these continuous coil springs have been found to be difficult or very expensive to modify in order to obtain sections of the product which are more firm than other sections of the same spring product. Specifically, it is sometimes desirable to make a spring product such as a mattress which is firm in the center section of the product and softer at the ends. Such a firm center section is sought because the greater portion of the weight carried by the mattress is carried by the center section. However, up until this invention no practical method or design had been found for varying the firmness of different sections of a continuous coil spring product.

Still another problem encountered in the manufacture of transversely laced continuous coil spring products is attributable to the difficulty of converting from one width mattress to another, as for example from a twin size to a double size mattress unit. In many instances the only difference between two mattresses may be in the width of the unit, but to change the width of a continuous coil spring product requires converting the set-up of the continuous coil forming machine and the assembly machine. This set-up conversion may involve many hours of machine set-up time for only a small number of a second size of unit.

It has therefore been a primary objective of this invention to create a continuous coil spring product which is so constructed that various sections of the product may be varied in firmness.

It has been another objective of this invention to provide a continuous coil spring product which is so constructed that it may be easily varied in width without any substantial variation in machine set-up and without any need to modify or change the set-up of the machine which forms a strand of wire into a plurality of interconnected coils.

Still another objective of this invention has been to provide a continuous coil spring assembly in which the center section of the assembly may be of increased firmness relative to the end section of the assembly.

In the past it has been the practice to manufacture continuous coil spring products by first forming a plurality of rows of coil springs from single wires and to then assemble the transversely extending individual rows by means of helical lacing wires (as in U.S. Pat. No. 3,911,511) or zig-zag wires (as in U.S. Pat. No. 3,657,749), which extend parallel to the rows and tie together adjacent rows. This construction though does not lend itself to making the center section of the spring unit more firm than the end sections because such increased firmness can only be achieved by increasing the thickness of wire used in the centermost rows of coils or by changing the diameter of the coils of the centermost rows or some other change which requires that the centermost rows differ from the end rows. Such a difference though is relatively impractical because it requires the use of different forming machines for forming the coils of a single spring unit or a much more complex assembly machine for assembling those different coils. From a cost standpoint this approach is impractical.

To achieve the objective set forth hereinabove, the invention of this application utilizes multiple identical longitudinally extending rows of continuous coils and ties those longitudinally extending rows together with longitudinally extending lacing wires.

One advantage of this construction is that it enables varying widths of spring units or mattresses, as for example twin and double size mattresses, to be made on a coil forming machine and a coil assembly machine without any modification of the machines. All that is required is to simply add an additional row or rows of longitudinally extending continuous coils to the unit in going from a narrow, as for example a twin size mattress, to a wider or so-called double size unit.

Still another advantage of this construction is that it enables the individual coils of the rows of continuous coils to be varied in spacing within each individual row so as to vary the spacing in the center of the spring unit. Thus, the rows of coils may be closely spaced in the longitudinal center section of the assembly to make this section firm and more widely spaced in other sections, as for example at the outer ends of the assembly to give those sections a softer feel.

These and other objects and advantages of this invention will be more readily apparent from the following description of the drawings in which:

FIG. 5 is an enlarged fragmentary top plan view of a portion of the assembly shown in FIG. 1.

Figure 1:
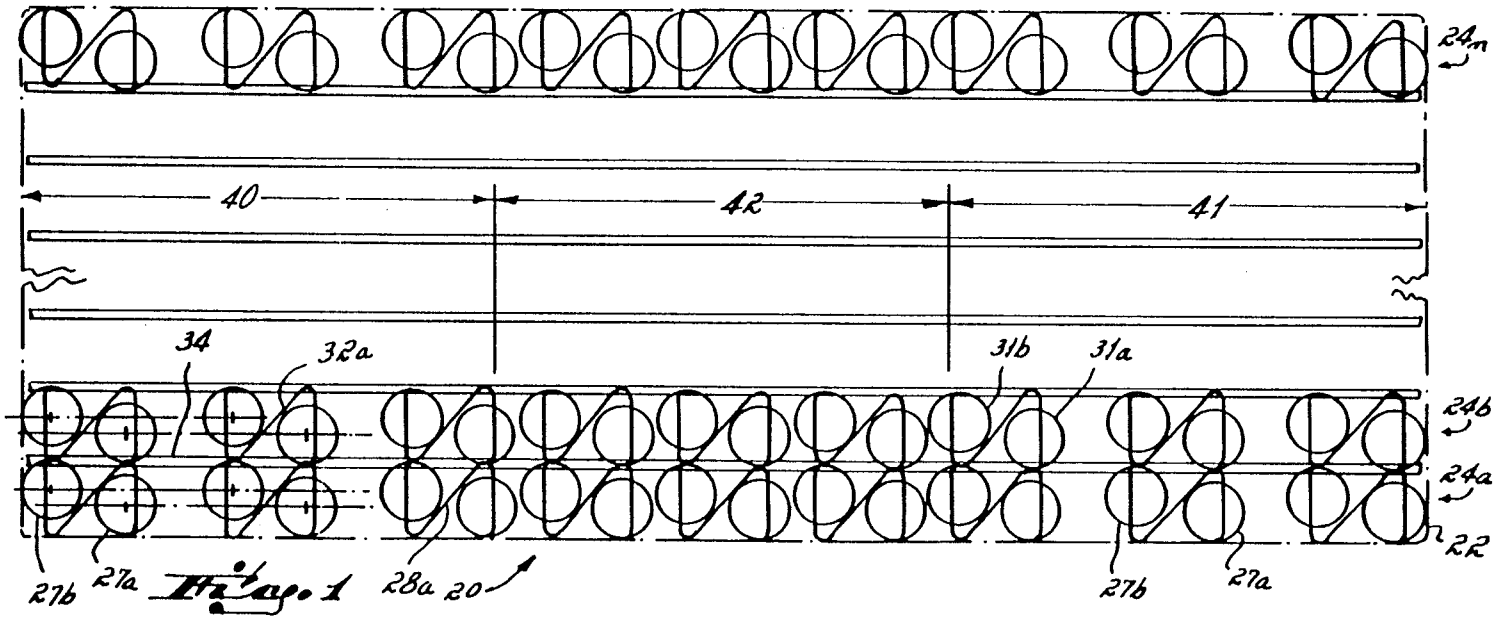
FIG. 1 is a top plan view of an innerspring assembly embodying the invention of this application.
Figure 2:
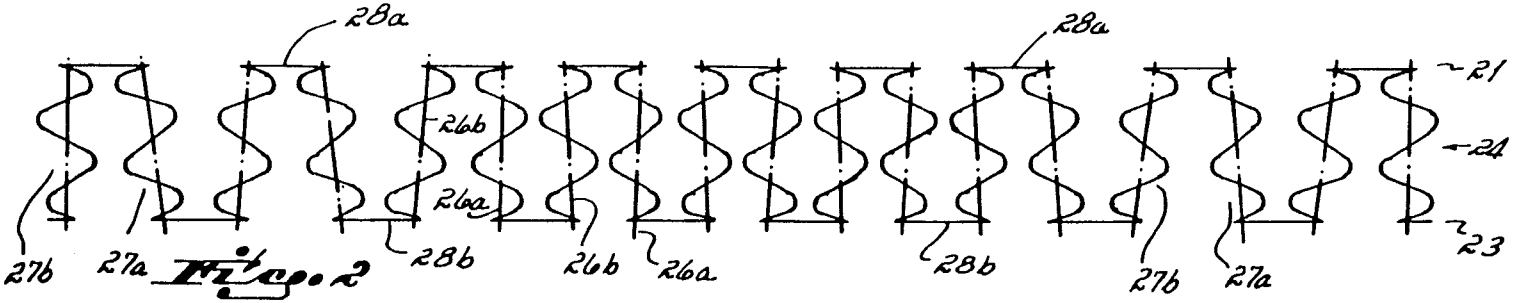
FIG. 2 is a side view of the assembly of FIG. 1.
Figure 3:
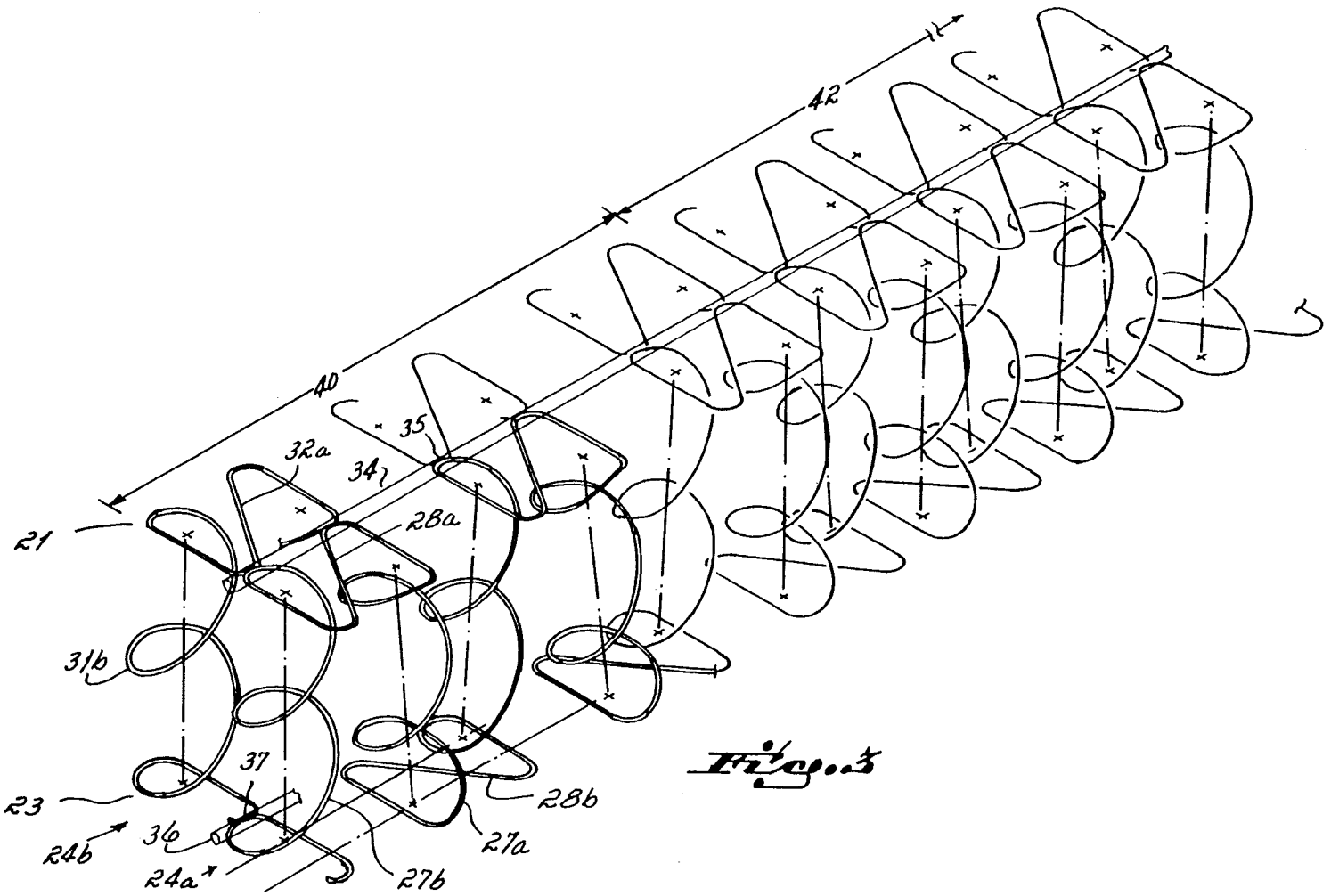
FIG. 3 is a perspective view of a corner of an innerspring embodying the invention of the application.

Referring now to the drawings, and particularly to FIGS. 1 and 2, there is shown an innerspring unit 20 utilizing a spring assembly made in accordance with the invention of this application. The upper surface 21 of innerspring 20 has a generally rectangular periphery 22 which may be enclosed by a border wire (not shown). Similarly, the lower surface 23 of innerspring 20 has a rectangular periphery which also may be enclosed by a border wire (not shown).

Innerspring 20 includes a plurality of rows 24*a*, 24*b*, 24*n* of coils, all of the same twist, as, for example, all right handed twist or all left handed twist. Each row 24*a*, 24*b*, and 24*n* of coils is formed from a continuous length of wire. The wire is wound to form a plurality of spaced coil pairs interconnected by substantially Z-shaped wire segments 28*a*, 28*b* disposed sequentially first in the plane of upper innerspring surface 21 and then within the plane of lower innerspring surface 23.

Figure 4:
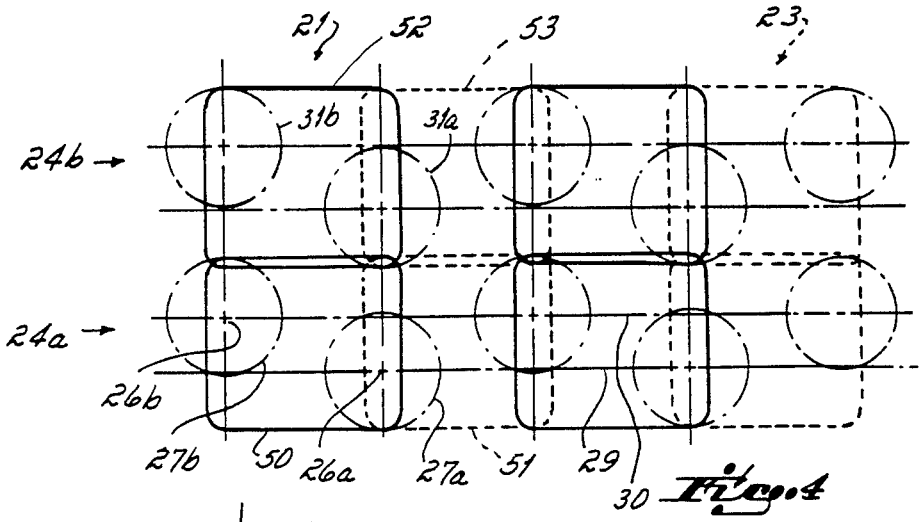
FIG. 4 is a diagrammatic plan view in which each coil pair in each row is designated by block lines constituting continuations of the Z-shaped coil interconnection segments.
Figure 3:
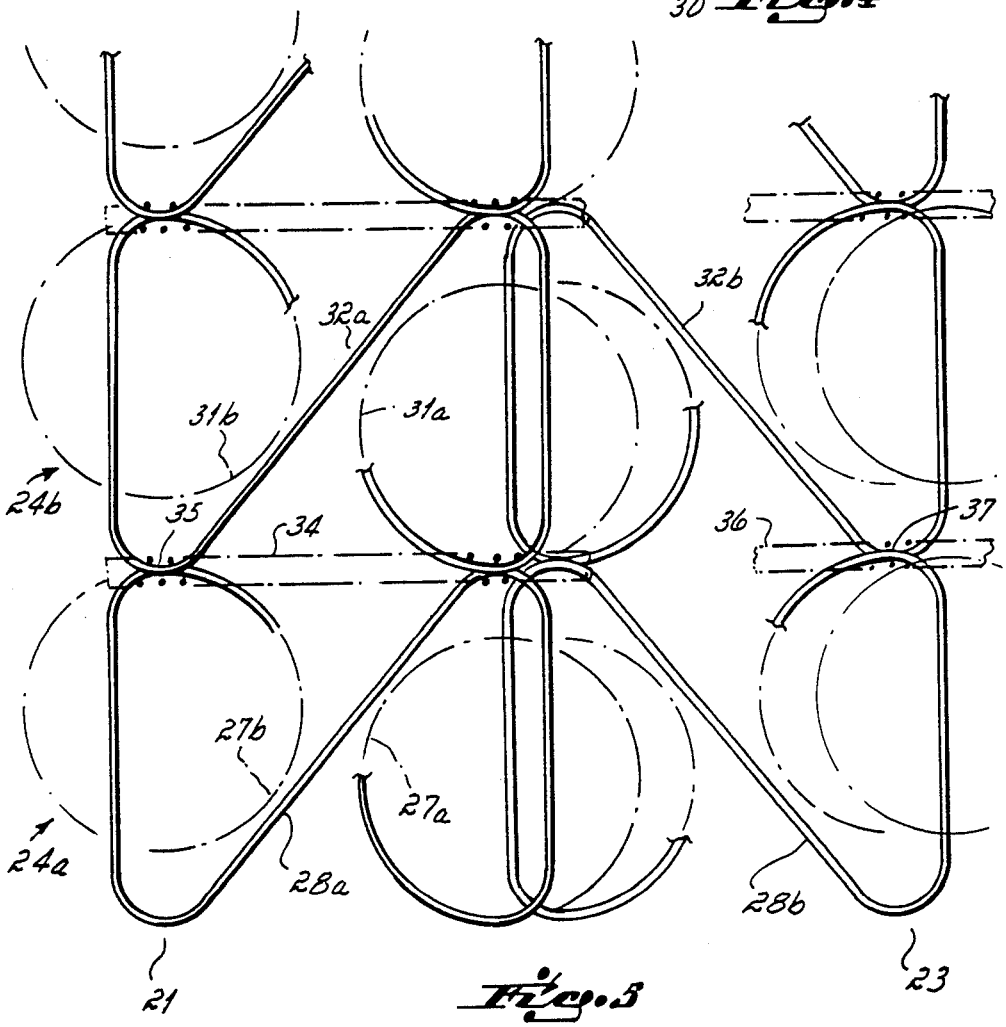

As best illustrated in FIGS. 1 and 4, each coil pair comprises a first right handed coil 27*a* offset from a second right handed coil 27*b*, having the same number of turns as coil 27*a*. The axes 26*a* of coils 27*a* lie within a plane 29 which is parallel to, but spaced apart from, a second plane 30 within which lie the axes 26*b* of offset coils 27*b*. It will appreciated that the axes 26*a*, 26*b* of adjacent coils 27*a*, 27*b* are equidistant, the axes, when formed, being generally perpendicular to the upper and lower surfaces 21 and 23 of innerspring unit 20. These axes 26*a*, 26*b* when assembled to manufacture the innerspring unit of this invention are angulated one to another, in a manner described below.

While each of the coils 27*a* and 27*b* is illustrated as having approximately one and one-half full turns or convolutions, this number is not critical. Thus, a greater or lesser number of convolutions may be used, depending upon the tensile strength of the wire and the manner in which the coils are formed so as to provide a spring force appropriate to the particular application.

As will be appreciated from the following description, the coil interconnection technique utilized in innerspring mattress 20 prevents adjacent coils from binding when compressed even though they are not of hourglass configuration. Thus, a variety of shapes may be employed such as hourglass or potbellied, but the cylindrical shape illustrated is preferred.

Each row 24*a*, 24*b*, 24*n* extends longitudinally of the spring unit. Each row is configured indential to each adjacent row and each coil within each row 24 is identical to every other coil and of the same twist or hand.

According to one aspect of the practice of this invention, and as explained more fully hereinafter, the spacing between axes of coils of a single row varies but the spacing of the axes of coils is the same from one row 24*a* to the next adjacent row 24*b*. Further, should a coil pair in row 24*a* be interconnected in the plane of upper innerspring surface 21, the adjacent coil pair in row 24*b* is interconnected in the same plane of upper innerspring surface 21. This is best illustrated in FIG. 5 where in row 24*a*, typical adjacent coils 27*a*, 27*b* are interconnected by Z-shaped wire segment 28*a* lying within upper innerspring surface. The adjacent coil pairs 31*a*, 31*b* in row 24*b* are interconnected by a Z-shaped wire segment 32*a* lying in the same plane of the upper innerspring surface 21 and Z-shaped wire segment 32*b* lying in the same plane of the lower surface. This pattern is repeated throughout the innerspring unit 20. The result is Z-shaped segments in the plane of the upper surface 21 aligned in columnar fashion and similarly the Z-shaped segments in the plane of the lower surface 23 are also aligned in columnar fashion in vertical planes which are located midway between the vertical plane of the Z-shaped segments in the plane of the upper surface 21. Otherwise expressed, the Z-shaped segments which interconnect the pairs of coils are aligned both in rows and in columns in the planes of the upper and lower surfaces 21 and 23.

In order to connect the adjacent rows of coils, the Z-shaped segments which interconnect adjacent pairs of coils within each row are positioned so that they overlap the Z-shaped segments of the adjacent row of coils. These overlapped portions or sections of the Z-shaped segments are then tied together by helical wire connectors. A first helical wire connector, herein designated 34, is disposed within the plane of upper innerspring surface 21 so as to join together overlapped portions 35 of upper Z-shaped interconnection segments 28*a*, 32*a*. Similarly, a second helical wire connector, herein designated 36, lies within the plane of lower innerspring surface 23 and serves to join together overlapped portions 37 of lower Z-shaped interconnection segments 28*b* and 32*b*. As evident in the plan view of FIG. 1, the length of each helical wire is approximately the same as the length of the rows, and the helical wires 34, 36 extend parallel to the rows.

The assembly of the helical wires to the row of continuous coils may be accomplished on an assembly machine. In such a machine, the adjacent rows of coils are positioned so that the sections 35 and 37 of the adjacent Z-shaped segments are positioned in overlapping relationship and a helical wire is then rotated or screwed onto the overlapping portions of the Z-shaped segments. After completion of the threading of the helical coil onto the Z-shaped segments, the now connected adjacent rows of coils may be indexed forwardly and another pair of upper and lower helical wires threaded over the next row of coils. This process is repeated for the desired width of the mattress, after which the spring assembly is removed from the machine.

With reference now to FIG. 2 it will be noted that the axes 26*a*, 26*b* of the coil pairs 27*a*, 27*b* of each longitudinal row 24*a*, 24*b*, 24*n* are angled out of a vertical plane. Note particularly that the axes of the three coil pairs of the head end section 40 and the foot end section 41 are angled in an opposite direction from the axes of the coil pairs in the center or body segment 42 of the row. This different angulation of selected axes 26 of the coils enables the coils in the center section 42 of the spring unit 20 to be spaced more closely together and the coils at the head and foot ends 40, 41 of a row to be spaced further apart. The angle variation of one coil to another is possible because the Z connectors 28*a*, 28*b* of the top and lower surfaces 21, 23 alternately connect different pairs of coils. Heretofore, it has been the common practice to extend the rows transversely of the unit and to have the axes of each coil within the row located as nearly as possible in a vertical plane. Consequently, the coils within a row were equidistantly spaced throughout the row. According to the practice of this invention though, the rows extend longitudinally of the spring unit and the coils in the center one-third section 42 of the spring unit 20 are more closely spaced than the coils in the head and foot end sections 40, 41. For example, if the coils are all formed with a nominal center-to-center distance of 3½ inches, the space between the coils may be varied by angling the axes 26 so that the coils in the center third 42 of the unit 20 are spaced three inches apart in center-to-center distance and the coils in the head and foot ends 40, 41 of the unit 20 are spaced four inches apart in center-to-center distance. Angling of the axes 26 of the coils enables this center-to-center distance to be varied among coils within the same row. Because the rows extend longitudinally of the spring unit, the longitudinal center section 42 of the spring unit has the coils more closely spaced with the result that that center section is more firm than the longitudinally spaced outer end sections 40, 41.

Referring now to FIG. 4, each block 50 represents the outline of a typical upper Z-shaped interconnection segment 28*a* in coil row 24*a*. Similarly, each block 52 represents the outline of a typical upper Z-shaped interconnection segment 32*a* in coil row 24*b*. Each block 51 represents the outline of typical lower Z-shaped interconnection segment 28*b* in coil row 24*a* and each block 53 represents the outline of a typical lower Z-shaped interconnection segment 32*b* in coil row 24*b*. As is apparent from the diagram in FIG. 4, the blocks 50, 52, and 51, 53 represent load supporting units. Each of these units 50, 52, and 51, 53 are overlapped so that the effect of the construction of coil assembly is one of the very densely packed innerspring assembly with a very high count of coils.

Figure 6:
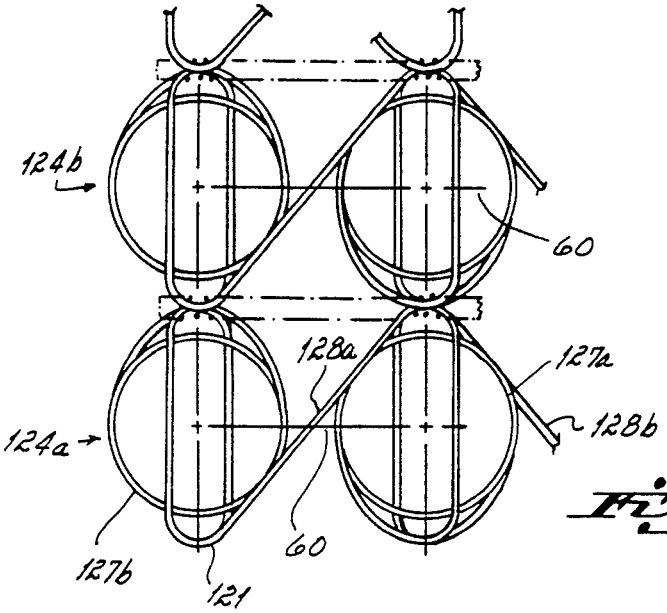
FIG. 6 is a fragmentary top plan view of a second embodiment of the invention of this application.
Figure 7:
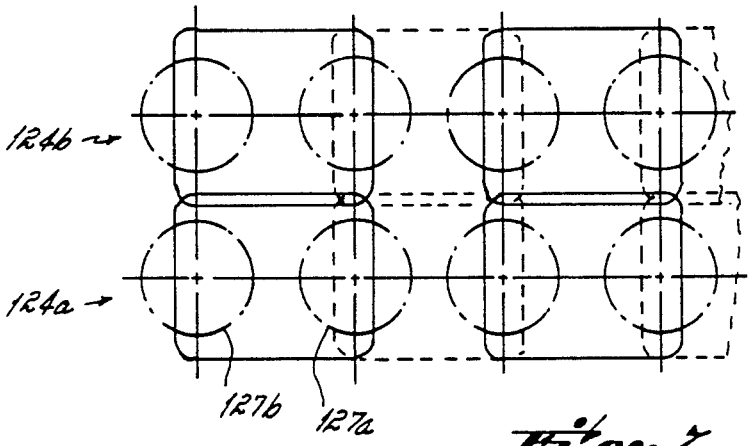
FIG. 7 is a diagrammatic plan view of the embodiment of FIG. 6 in which each coil pair in each row is designated by block lines constituting continuations of the Z-shaped coil interconnecting segments.

Referring to FIGS. 6 and 7, there is illustrated a second embodiment of the invention of this application. This construction is illustrated diagrammatically in top plan view in FIG. 8.

In general, the spring assembly of FIGS. 6 and 7 is identical to the spring assembly of FIGS. 1–5, except that the rows of coils are positioned within the interconnecting Z-shaped segments so that the vertical axes of all of the coils of a single row are located in the same vertical plane 60, rather than being alternately staggered in two different planes as in the embodiment in FIGS. 1–5. The Z-shaped segments, rather than extending outwardly from one side only of each coil extend outwardly beyond both sides of each coil so that this construction has the same advantages of the embodiment of FIGS. 1–5 in that it minimizes or eliminates any tendency of the coils to overlap or contact adjacent convolutions of the same coil. Specifically, it will be seen that in this embodiment each row of coils 124*a*, 124*b*, is formed from a continuous length of wire and each wire is wound to form a plurality of spaced coil pairs interconnected by substantially Z-shaped wire segments 128*a* disposed in the plane of upper innerspring surface. The substantially Z-shaped wire segments 128*b* interconnect adjacent coil pairs within the plane of lower innerspring surface.

In this embodiment each coil pair comprises a first right handed coil 127*a* offset from a second right hand coil 127*b* having the same number of turns as coil 127*a*. In this embodiment though the axes of coils 127*a* lie within the same plane 60 within which lie the axes of coils 127*b*. In this embodiment as in the embodiment of FIGS. 1–5, each row 124*a*, 124*b*, is configured identically to each adjacent row and each coil within each row is of the same twist or hand. While the two embodiments of this invention have been illustrated as being of the same twist or hand throughout the spring unit, they could as well be of differing twist or of a mix of twists or rotational hands and still practice the invention of this application.

In this embodiment, the corners of the interconnecting Z-shaped segments are both located outwardly from the circumference of the coils 127*a* and 127*b* within each pair of coils in both the planes of the upper and lower surfaces of the mattress.

One advantage of this invention over prior are spring assemblies in which the continuous rows of coils extended transversely of the unit rather than longitudinally, is that it enables the longitudinal center section 42 of the spring unit to be made more firm than the outer end sections 40, 41. As explained hereinabove, this increased firmness in the center section 42 of the spring unit 20 is accomplished by angling the axes 26 of the individual coils within a row 24 such that the coils in the center section 42 of the spring unit 20 are pulled inwardly toward one another and the coils in the outer ends 40, 41 of the rows 24 are angled outwardly relative to one another. Thereby, the longitudinal center section 42 of the spring unit 20 is made more firm than the longitudinal outer end sections 40, 41.

While I have described only two embodiments of my invention, persons skilled in the art to which this invention pertains will appreciate other changes and modifications which may be made without departing from the spirit of my invention. Therefore, I do not intend to be limited except by the scope of the following appended claims.

Having described my invention, I claim:

1. A spring assembly having a long longitudinal dimension and a shorter transverse dimension, said assembly comprising, a plurality of parallel rows of coils, each of said rows extending longitudinally of the spring unit, each of said rows being formed from a single continuous piece of wire and each of said rows containing a plurality of coils interconnected by interconnecting segments, alternate ones of said interconnecting segments being disposed in the planes of the upper and lower surfaces of said spring assembly, the axes of said coils in at least a large portion of said assembly being disposed generally perpendicular to the upper and lower surfaces of said spring assembly, sections of each of said interconnecting segments of each row being overlapped relative to connecting segments of an adjacent row, helical lacing means extending longitudinally parallel to said rows for the length of said rows, said helical lacing means being wound through sections of said interconnecting segments so as to secure said rows of coils in an assembled relation, the axes of the coils in the center section of each of said rows being angled differently than the coils at the outer ends of each of said rows, the axes of adjacent coils at the outer ends of said row being angled oppositely so that the coils in the center section of each of said longitudinally extending rows of coils are more closely spaced than the majority of coils at the outer ends of each of said rows whereby greater firmness is imparted to the center section of said spring assembly than is imparted to the outer end sections.

2. The spring assembly of claim 1 in which the coils in the center section of each of said rows of coils are angled inwardly toward the adjacent coils.

3. The spring assembly of claim 1 in which the coils in the center section of each of said rows of coils are angled inwardly toward the adjacent coils and the coils at the outer end sections of each of said rows of coils are angled oppositely away from the adjacent coil.

* * * * *